US006114810A

United States Patent [19]

Foo

[11] Patent Number: 6,114,810

[45] Date of Patent: Sep. 5, 2000

[54] ELECTRONIC BALLAST CIRCUIT FOR FLUORESCENT LAMPS WHICH HAVE A HIGH Q FACTOR AND HIGH RESONANCE VOLTAGE

[75] Inventor: Onn Fah Foo, Kowloon, The Hong Kong Special Administrative Region of the People's Republic of China

[73] Assignee: Mass Technology (H.K.) Ltd., Kowloon, The Hong Kong Special Administrative Region of the People's Republic of China

[21] Appl. No.: 09/064,012

[22] Filed: Apr. 22, 1998

[30] Foreign Application Priority Data

Jan. 19, 1998 [CN] China ..... 98 1 04011

[51] Int. Cl.[7] ..... H05B 37/02

[52] U.S. Cl. ..... 315/105; 315/106; 315/107

[58] Field of Search ..... 315/94, 99, 101, 315/102, 104, 105, 106, 107, DIG. 5, DIG. 2

[56] References Cited

U.S. PATENT DOCUMENTS 4,647,817 3/1987 Fahnrich et al. ..... 315/104

5,122,712 6/1992 Hirschmann ..... 315/106

5,349,270 9/1994 Roll et al. ..... 315/209 R

*Primary Examiner*—David Vu

*Attorney, Agent, or Firm*—Smith, Gambrell & Russell, LLP

[57] ABSTRACT

An electronic ballast circuit for fluorescent lamps, said circuit comprises an anti-interfering circuit, a rectifying circuit, a filtering circuit, a frequency-converting circuit and a resonant circuit connected sequentially; a main resonant capacitor C4 is connected between the end of the the fluorescent lamp connected with the resonant inductor L1 in the resonant circuit and the negative end of the filtering circuit, so that resonant inductor L1 and main resonant capacitor C4 constitute a main resonant circuit; the Q factor of the main resonant circuit is not affected by the resistance of the filaments at both ends of the fluorescent lamp, so that the voltage applied across both ends of the lamp can be raised; and a preheating circuit is provided between both two ends of the main resonant capacitor, so that the filaments of the lamp can be preheated before the lamp is started.

3 Claims, 3 Drawing Sheets

ELECTRONIC BALLAST CIRCUIT FOR FLUORESCENT LAMPS WHICH HAVE A HIGH Q FACTOR AND HIGH RESONANCE VOLTAGE

BACKGROUND OF THE INVENTION

The present invention relates to an ignite or control circuit device for discharge lamps, more particularly, the present invention relates to an electronic ballast circuit for fluorescent lamps.

Electronic ballast circuits for fluorescent lamps usually adopt a series resonant circuit, that is to say, a resonant circuit consisting of a capacitor, the resistances of the filaments and an inductor connected in series is used to produce a high voltage across the ends of the fluorescent lamp to ignite it, and a rectifying circuit, a filtering circuit and a frequency-converting circuit are sequentially connected between the power supply and the series resonant circuit, with an optional anti-interfering circuit provided before the rectifying circuit in some of the electronic ballast circuits. In this kind of electronic ballast circuit, the resistance of the filaments of the fluorescent lamp might reduce the Q factor of the series resonant circuit, which causes the resonance voltage to be insufficient to ignite the fluorescent lamp, and the lamp will be difficult to start; if the lamp is directly ignited with the filaments resistance shorted, the lamp is started without preheating the filaments, and the life of the filaments of the fluorescent lamp will be significantly reduced by this kind of cold cathode starting; moreover, this kind of existing electronic ballast circuit is suitable to a power supply of 200–240 volts, when the voltage of the power supply is 100–120 volts, the resonant voltage thereof cannot meet the requirement for the normal igniting of the fluorescent lamp.

The object of the present invention is to overcome the disadvantages of the above conventional electronic ballast circuits, and to provide an electronic ballast circuit for fluorescent lamps which has high Q factor and high resonance voltage.

BRIEF SUMMARY OF THE INVENTION

To realize this object, the following technical scheme is adopted: the ballast circuit includes, an anti-interfering circuit, a rectifying circuit, a filtering circuit, a frequency-converting circuit and a resonance circuit connected sequentially, the resonance circuit comprises a resonant capacitor, the resistance of the filaments of the fluorescent lamp, and a resonant inductor connected in series, characterized in that, in the resonant circuit, a main resonant capacitor is provided between the end of the fluorescent lamp connected with the resonant inductor and the negative end of the filtering circuit, so that the resonant inductor and the main resonant capacitor form a main resonant circuit, and in the high frequency AC loop, the voltage across the ends of the main capacitor is just the starting voltage between the ends of the fluorescent tube.

Since the present invention utilizes the resonant inductor of the resonance circuit, and a main capacitor is provided between the end of the fluorescent lamp connected with the resonant inductor and the negative end of the filtering circuit, the Q factor of the main resonant circuit will not be affected by the resistance of the filaments at both ends of the fluorescent lamp, so the voltage applied to the ends of the lamp can be raised.

BRIEF DESCRIPTION OF THE DRAWINGS

The invention is further described in detail with reference to the appended figures and embodiments, in which.

DETAILED DESCRIPTION OF THE INVENTION

Figure 1:
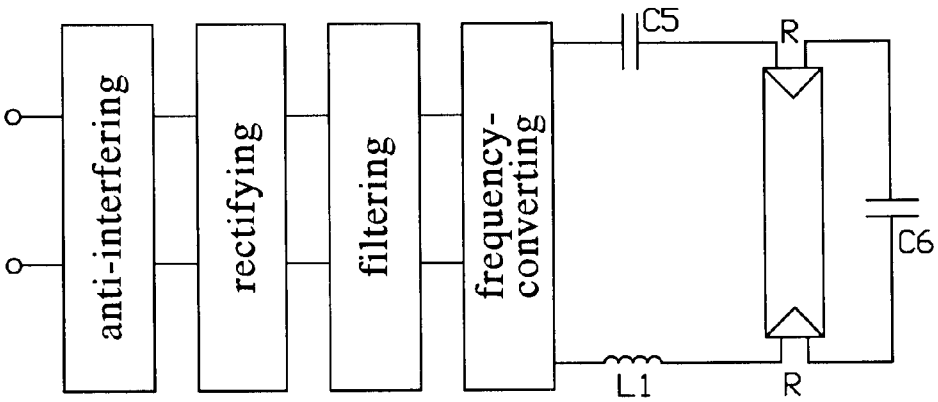
Figure 1 (Prior Art)
FIG. 1 is a block diagram illustrating an electronic ballast circuit of the prior art.
Figure 2:
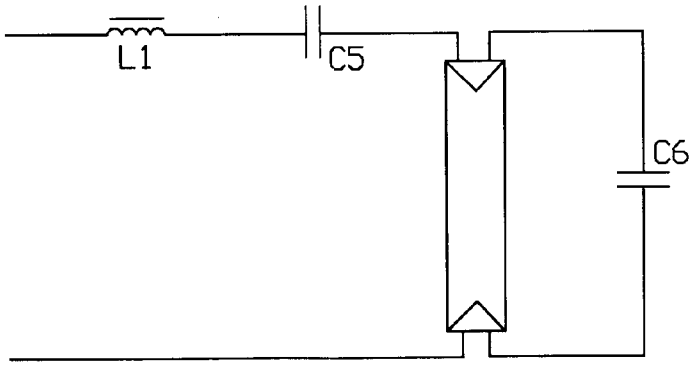
Figure 2 (Prior Art)
FIG. 2 is a block diagram illustrating another electronic ballast circuit of the prior art.

As shown in FIG. 1, the conventional electronic ballast circuit generally has the following structure: an anti-interfering circuit, a rectifying circuit, a filtering circuit and a frequency-converting circuit are sequentially connected to the input of the 220 V power supply, and a series resonant circuit is provided after the frequency converting circuit, said resonant circuit includes resonant capacitors CS, C6 and resonant inductor L1, with the resistance of the filaments at both ends of the lamp also connected in series in the resonant circuit. This kind of resonant circuit is well known to those skilled in the art, the Q factor of the series resonant circuit would be decreased by the effect of the resistance of the filaments at the ends of the fluorescent lamp, which causes the resonance voltage to be insufficient to start the lamp. Moreover, most of these circuits are designed for using with a 220±20 V power supply, if the voltage of the power supply is 110±10 V, the lamp will be even more difficult to start. To solve the problem in starting the lamp, one method is to have the resistances of the filaments at both ends of the lamp short-circuited as shown in FIG. 2, this will raise the Q factor of the series resonant circuit and, with it, the voltage between the ends of the lamp, thus starting the lamp. However, the disadvantage of thus doing is that the filaments have not been preheated, the lamp is directly started with cold cathode, and the life of the lamp will be significantly reduced, so it is not a preferable method to solve the problem.

Figure 3:
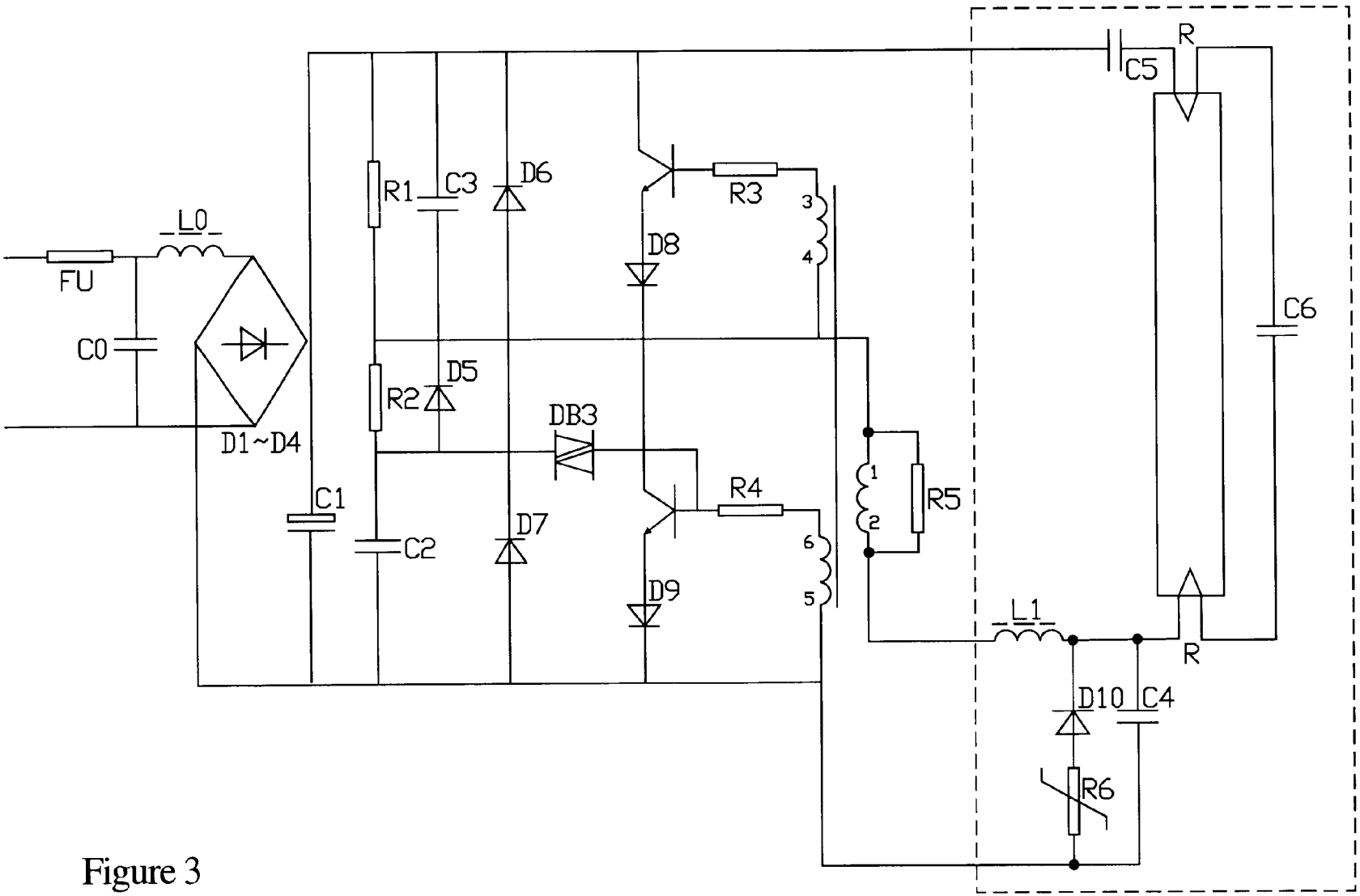
FIG. 3 is a schematic diagram illustrating the principle of the present invention.
Figure 4:
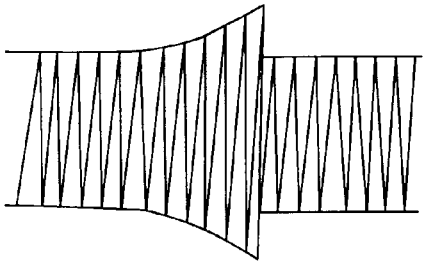
FIG. 4 shows the waveform of the electric current passing through the fluorescent lamp during the starting process.
Figure 5:
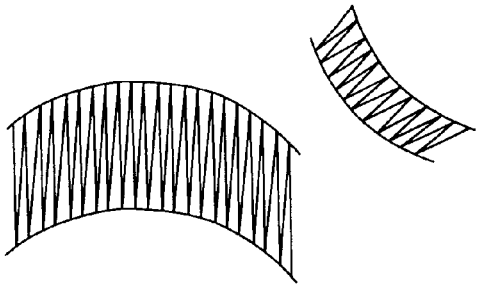
FIG. 5 shows the waveform of the voltage across the fluorescent tube during the starting process.
Figure 6:
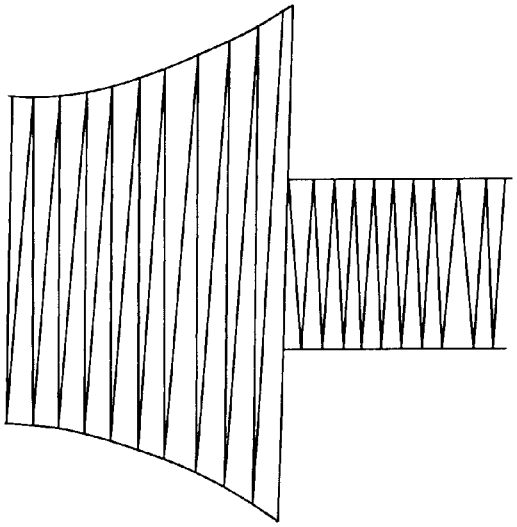
FIG. 6 shows the waveform of the voltage across the ends of PTC thermistor R6 during the starting process.
Figure 7:
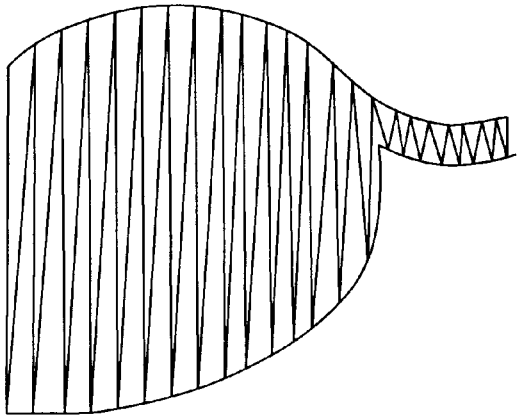
FIG. 7 shows the waveform of the electric current passing through PTC thermistor R6 during the starting process.

With reference to FIG. 3 and comparing with FIG. 1, the anti-interfering circuit consists of C0 and L0; the rectifying circuit consists of diodes D1–D4; the filtering circuit consists of filtering capacitor C1; the frequency-converting circuit consists of resistances R1–R4, capacitors C2–C3, diodes D5–D9, transistors BG1–BG2, bidirectional silicon-controlled rectifier, and transformer the series resonant circuit consists of capacitors C5–C6, the resistances of the two filaments, and resonant inductor L1, while the main resonant circuit consists of resonant inductor L1 and main resonant capacitor C4, as shown in the region surrounded by dash lines in FIG. 3, one end of capacitor C4 is connected to the node of the inductor L1 and the fluorescent lamp, the other end of capacitor C4 is connected to the negative end of filtering capacitor C1 (the end 5 of the primary winding of transformer B). As can be seen from FIG. 3, for the high frequency AC loop, the voltage across both ends of the main capacitor C4 equals to the voltage across the ends of the fluorescent lamp, thus preventing the Q factor of the main resonant circuit from being effected by the resistance of the filaments, so that the lamp can be normally started. To preheat the filaments at both ends of the fluorescent lamp, a preheating circuit is provided between both ends of the main resonant capacitor C4, the preheating circuit consists of diode D10 and PTC thermistor R6 connected in series, when starting the lamp, the high voltage between both ends of C4 is subject to the unidirectional clamping of the diode D10 and PTC thermistor R6 in the preheating circuit, thus the voltage across C4 is made comparatively low, the lamp cannot be started owing to the voltage across the fluorescent lamp being lower than the ignite voltage and, at this time, the current preheats the filaments. When the temperature of PTC thermistor R6 is raised above a lower limit, the voltage across the lamp is raised correspondingly, and the lamp is started. The waveform of the current passing through the fluorescent lamp and the waveform of the voltage across the lamp during the starting process are shown in FIG. 4 and FIG. 5, respectively. Once the lamp operates normally, as can be seen from FIG. 7, the current passing through PTC thermistor R6 is very small, thus the power consumption in the PTC thermistor R6 itself is very low, because diode D10 is at a state of high electric level, its conducting angle is very small (the voltage across PTC thermistor R6 is shown in FIG. 6).

Figure 8:
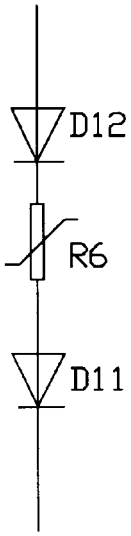
FIG. 8 is another schematic diagram of the preheating circuit of the present invention.

With reference to FIG. 8, the preheating circuit may also consist of two diodes D11–D12 and PTC thermistor R6 connected in series, the two diodes are placed in the circuit in the same polarity, and the PTC thermistor R6 is located between diodes D11 and D12. Of course, the manner of connecting the PTC thermistor R6 is not limited to this, PTC thermistor R6 may be connected to the anode of diode D11 or to the cathode of diode D12. And PTC thermistor R6 may be replaced by a common resistor.

In fabricating, the preheating circuit may be designed as an integrally sealed assembly, that is to say, the serially connected diode and thermistor are integrally sealed in a package, so that it will be easier to install, to connect, and to form the final product.

What is claimed is:

1. An electronic ballast circuit for a fluorescent lamp having filaments, comprising:

an anti-interfering circuit, a rectifying circuit, a filtering circuit, a frequency-converting circuit and a series resonant circuit connected sequentially, said series resonant circuit consisting of a first resonant capacitor, the resistance of the filaments of said fluorescent lamp and a resonant inductor connected in series, said fluorescent lamp having a first end and a second end, wherein a second resonant capacitor (C4) is directly connected between said first end of said fluorescent lamp which is connected with said resonant inductor (L1) in said series resonant circuit and a negative end of said filtering circuit, so that said resonant inductor (L1) and said second resonant capacitor (C4) constitute a main resonant circuit, and, in the high frequency AC loop, wherein voltage across both ends of said second resonant capacitor (C4) being the starting voltage of said lamp, and wherein a preheating circuit is connected in parallel between both ends of said second resonant capacitor (C4) in said main resonant circuit, said preheating circuit being an integrally sealed assembly.

2. The electronic ballast circuit according to claim 1, wherein said preheating circuit consists of a diode (D10) and a PTC thermistor (R6) connected in series.

3. The electronic ballast circuit according to claim 1, wherein said preheating circuit consists of two diodes(D11) –(D12) and a PTC thermistor (R6) connected in series.

* * * * *